United States Patent [19]

Kusmer

[11] 4,272,072

[45] Jun. 9, 1981

[54] WAIST MOUNTED EXERCISE DEVICE

[76] Inventor: Kasimir C. Kusmer, 7220 Sutliff St., Burnaby, B.C., Canada, V5A 1M9

[21] Appl. No.: 115,501

[22] Filed: Jan. 25, 1980

[51] Int. Cl.[3] ..... A63B 69/10; A63B 21/26

[52] U.S. Cl. ..... 272/71; 272/126; 272/143

[58] Field of Search ..... 272/71, 126, 143, 93, 272/128, 119, 123, 128, 72, 116; 273/DIG. 19

[56] References Cited

U.S. PATENT DOCUMENTS

| | | | |
|---|---|---|---|
| 232,218 | 9/1880 | Tuttle | 272/143 |
| D. 239,648 | 4/1976 | Somsky | 273/DIG. 19 |
| 497,774 | 5/1893 | Denison | 272/126 |
| 2,014,192 | 9/1935 | Stoker | 272/71 |
| 3,186,124 | 6/1965 | Voss | 272/143 X |
| 3,342,482 | 9/1967 | Paolone | 272/117 |
| 3,532,340 | 10/1970 | Nardiello | 272/128 |
| 3,731,921 | 5/1973 | Andrews | 272/71 |
| 3,820,781 | 6/1974 | Kane | 272/126 |
| 3,884,464 | 5/1975 | Evangelos | 272/126 X |
| 3,942,790 | 3/1976 | Rice | 272/126 X |

*Primary Examiner*—Richard J. Johnson
*Attorney, Agent, or Firm*—Larson and Taylor

[57] ABSTRACT

A waist mounted exercise device is disclosed which can be easily and conveniently used by an operator. The exercise device includes a waist encircling member which is strapped to the waist and which has a post protruding from the center of the waist. Suitably mounted for pivoting on the post is a bracket from which rods extend on either side of the operator. These rods are adjustably clamped in place in the bracket so as to position a ball on the distal end of each rod within reach of each outstretched hand. Exercise is performed by grasping a ball in each hand and moving the arms in a swimming motion. This motion also causes the torso to sway back and forth.

6 Claims, 2 Drawing Figures

WAIST MOUNTED EXERCISE DEVICE

FIELD OF THE INVENTION

The invention relates generally to exercise devices and more particularly to an exercise device which pivots about the waist of a user when the user's outstretched hands grasp the ends of two rods and move in a swimming motion.

BACKGROUND OF THE INVENTION

There has been disclosed in the prior art a large number of exercise devices. Some of these have included a waist engaging member. For example, in U.S. Pat. No. 3,532,340 to Nardiello, an exercise device comprising an outer ring mounted to a waist encircling member by springs is disclosed. Exercise occurs when the outer ring is grasped by the hands of the user and rotated against the pull of the springs. Another device, which is used both for recreation as well as exercise is disclosed in U.S. Pat. No. 3,342,482 to Paolone. This patent discloses an elongate flexible rod which extends from the center of a waist encircling belt and which has a ball on its distal end. By moving his hips, the user causes the ball to whip around in various patterns or at random. A toy device which is strapped to the waist of the user is disclosed in U.S. Pat. No. Des. 239,648 to Somsky. This toy has a waist mounted frame extending on either side of the user. At each end of the frame is a funnel opening upwards and a ball attached to a string hanging downwards. By manipulating the body, the user is supposed to cause the ball to swing around and drop in the funnel. There has also been disclosed in French Pat. No. 774,181 to Nathan a boxing exerciser in which a balloon is attached to the waist of the boxer by flexible cords so that after a punch the balloon is pulled back to the boxer by the flexible cords.

However, most of these prior art exercise devices require the user to move his body against a resilent member. In addition, the shoulders and arms are not exercised as well as the waist in most of these prior art devices.

SUMMARY OF THE PRESENT INVENTION

In accordance with the present invention, a waist mounted exercise device is provided for exercising the arms, shoulders and waist of the user. This device is easily adjusted to fit almost any user and is simple and easy to operate. This device is also readily collapsible for easy storage when not in use. According to a preferred embodiment, the invention comprises a waist mounted bracket which receives the proximal ends of two rods. The two rods extend in opposite directions and have end members which can be conveniently grasped by the outstretched hands of the user. The bracket is rotatably mounted to the waist and the rods are adjustable in the bracket. In use, the end members are grasped and the arms moved in a swimming motion.

Other features and advantages of the present invention are stated in or apparent from the detailed description of a presently preferred embodiment found hereinbelow.

DETAILED DESCRIPTION OF THE PREFERRED EMBODIMENT

Figure 1:
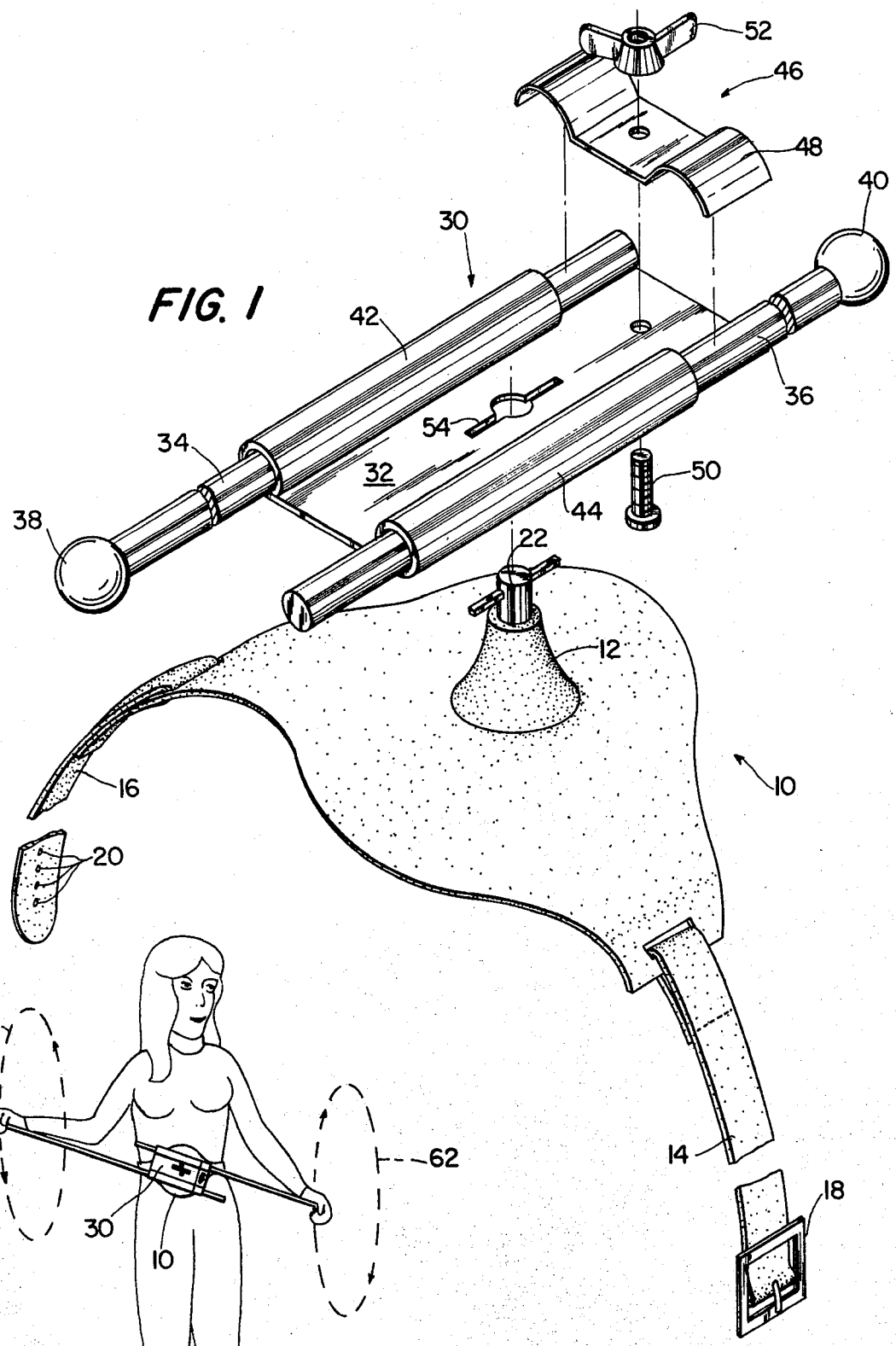
FIG. 1 is a schematic exploded perspective view of a preferred embodiment of the present invention.

With reference now to the drawings in which like numerals represent like elements throughout the several views, a presently preferred embodiment of the present invention is depicted in FIG. 1 and comprises a waist encircling member 10 and a rod assembly 30. Waist encircling member 10 is comprised of a pad 12 to which belt portions 14 and 16 are attached. Belt portions 14 and 16 have a buckle 18 and apertures 20 respectfully so that belt portions 14 and 16 can be adjustably secured around the waist of the user to hold pad 12 relatively immovable. Protruding outwardly from pad 12 is a circular post 22 with a transverse crossbar.

Also shown in FIG. 1, rod assembly 30 is comprised of a bracket 32 and rods 34 and 36. Mounted on the distal end of each rod is an end member 38 or 40 which can be conveniently grasped by the outstretched hand of the user. In this embodiment, end members 38 and 40 are ball shaped, but other relatively smooth knobs or grips can be used. The proximal ends of rods 34 and 36 are telescopically received in sleeves 42 and 44 of bracket 32. At one end of bracket 32 is a clamping means 46 for adjustably holding rods 34 and 36 to bracket 32. The clamping action of clamping means 46 is provided by a clamping bar 48 which overlaps both rods 34 and 36. Clamping bar 48 is urged toward bracket 32 by means of a threaded bolt 50 passing through bracket 32 and clamping bar 48 and a wing nut 52 which is screwed down on bolt 50. While other holding means for rods 34 and 36 may be provided, clamping means 46 provides an easy and quick method for adjusting the length of rods 34 and 36 extending away from bracket 32. Located in the center of bracket 32 is an elongated slot 54 with an enlarged circular center.

In use as an exercising device, waist encircling member 10 and rod assembly 30 function in the following manner. First, pad 12 is strapped to the waist of the user by belt portions 14 and 16. Post 22 extends outward from pad 12 so that the crossbar is vertical. The crossbar acts as a key and slot 54 in bracket 12 as a keyhole. Thus, when slot 54 is also vertically aligned, post 22 readily fits into slot 54. As slot 54 and rods 34 and 36 are rotated to a horizontal (operating) position, bracket 32 is then rotatably mounted on post 22. At this time, clamping means 46 can be loosened to position end members 38 and 40 of each rod 34 and 36 at a comfortable arm's length. Clamping means 46 is then tightened and exercise can begin.

Figure 2:
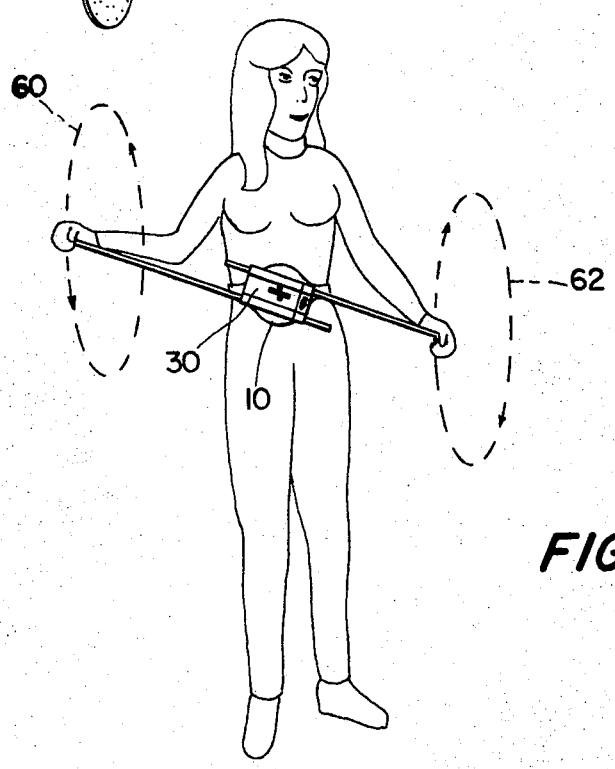
FIG. 2 is a schematic representation of the present invention being operated by a user.

A recommended exercise is for the user to grasp end members 38 and 40 with his hands and to then move the hands in a swimming motion as shown by dotted lines 60 and 62 in FIG. 2. This motion also causes the torso of the user to sway back and forth. This easy motion is used to exercise the arms, shoulders and waist of the user. When the user is through exercising, rod assembly 30 is easily detached from waist encircling member 10 by rotating slot 54 to a vertical position and withdrawing bracket 32 off of post 22. Waist encircling member 10 is then unbuckled and the entire exercise device can then be easily stored. If desired, rod 34 and 36 can be adjusted to a side-by-side position to provide a more compact rod assembly 30 for storage.

Although the present invention has been described in detail with respect to an exemplary embodiment thereof it will be understood by those of ordinary skill in the art that variations and modifications may be effected within the scope and spirit of the invention. Thus, for example, clamping means 46 could be replaced by another suitable holding means for rods 34 and 36 such as pins fitting through openings in sleeves 42 and 44 and in rods 34 and 36. In addition, instead of post 22 and slot 54, a variety of mounting means for pivotably holding rod assembly 30 to waist encircling member 10 can also be utilized. Other variations and modifications of the present invention are also possible.

I claim:

1. A waist mounted exercise device comprising:

a waist encircling member which is adapted to be placed relatively immovably around a user's waist;

a pair of elongate rods, each said rod having a distal and a proximal end;

an end member on the distal end of each rod which can be easily grasped by the hand of the user;

a bracket means for receiving the proximal ends of said rods that the distal ends of each rod are positioned on opposite sides of said bracket;

holding means for adjustably attaching said rods to said bracket means; and means for removably and rotatably mounting said bracket means on said waist encircling member;

such that exercise is performed by grasping said end members on said rods and moving said end members with the hands in a swimming motion causing the torso to sway back and forth.

2. An exercise device as claimed in claim 1 wherein said end members are spherical.

3. An exercise device as claimed in claim 1 wherein said mounting means includes a post protruding from said waist encircling member and a complementary aperture located in said bracket means.

4. An exercise device as claimed in claim 3 wherein said waist encircling member includes a pad from which said post protrudes.

5. An exercise device as claimed in claim 3 wherein said post has a vertically extending key which fits into a corresponding slot of said aperture when said bracket means is vertically aligned.

6. An exercise device as claimed in claim 1 wherein said holding means includes a clamp which is adjusted to clamp each rod at the same time.

* * * * *